United States Patent [19]

Antal

[11] Patent Number: 4,937,907

[45] Date of Patent: Jul. 3, 1990

[54] CLEANING PLUG ASSEMBLY

[76] Inventor: Michael P. Antal, 2037 Washington Rd., Apollo, Pa. 15613

[21] Appl. No.: 431,228

[22] Filed: Nov. 3, 1989

[51] Int. Cl.[5] ..... B08B 9/04

[52] U.S. Cl. ..... 15/104.061; 166/170; 166/176

[58] Field of Search ..... 15/104.061, 104.062, 15/104.011, 104.05, 3.5, 3.51; 166/170, 171, 172, 173, 174, 175, 176, 179, 196, 195, 181

[56] References Cited

U.S. PATENT DOCUMENTS

| | | | |
|---|---|---|---|
| 1,424,336 | 8/1922 | Bowman | 15/104.061 |
| 3,283,123 | 3/1964 | Atkinson et al. | 15/104.061 |
| 3,827,492 | 8/1974 | Hammon et al. | 166/173 |
| 3,939,519 | 2/1976 | Muirhead | 15/104.061 |

*Primary Examiner*—Harvey C. Hornsby
*Assistant Examiner*—G. Graham
*Attorney, Agent, or Firm*—Paul Bogdon

[57] ABSTRACT

A cleaning plug assembly for cleaning condenser and heat exchanger tubes and the like is disclosed. The plug is adapted to be propelled through a tube by fluid pressure injected into the tube, and includes an elongated body supporting annular rings extending radially outwardly for contacting the inner surface of a tube. The rings are selectively removable from the body of the plug and are formed to circumferentially contract and expand within the tube to be cleaned. The rings are secured against free rotation on the plug body by projections formed in circumferential grooves formed on the body for receiving the rings. The projections are sized to allow contraction of the rings.

8 Claims, 1 Drawing Sheet

CLEANING PLUG ASSEMBLY

BACKGROUND OF THE INVENTION

This invention relates to a cleaning plug assembly of the type used in cleaning the interior of condenser and heat exchanger tubes and the like, the plug assembly being adapted to be propelled through a tube by pressurized fluid injected into the tube.

To clean condenser and heat exchanger tubes, and the like, it is common to use plugs, sometimes referred to as pigs, which are propelled through the tubes by pressurized fluid. The known plugs are provided with scraper elements such as blades or brushes fixed to an elongated body such that the scraper elements contact the inner walls of the tubes. Problems have existed with the heretofore used plugs in that in some instances they do not provide effective contact between the scraper elements and the tube walls resulting in less than complete cleaning, and in other instances the scraper elements experience rapid wear necessitating frequent replacement of the entire plug at unnecessary expense. Other plugs are complex in their structure and thereby expensive, along with being oftentimes subject to rapid wear and ineffective scraper element-to-tube wall contact. With virtually all of the existing cleaning plugs the scraper elements are sized for use with certain sized tubes and make no provision for replacement of different sized scraper elements for use with different sized tubes.

This invention overcomes the heretofore inherent problems of existing cleaning plugs by providing a new and unique cleaning plug assembly which has an effective scraper element-to-tube wall contact, is simple in structure, and allows the use of different sized scraper elements on a single plug body for use with different sized tubes. Additionally, the cleaning plug of this invention allows for passageways in its body for receiving and directing fluid to aid in propelling the plug through a tube and for discharging into the tube to assist in the cleaning process. Also, the present cleaning plug may be formed of flexible materials capable of bending or flexing and resuming its original shape for allowing the plug to move through restricted areas or bends in the tubes. This invention further allows single replacement of worn scraper elements rather than requiring replacement of an entire plug whenever a scraper element experiences wear.

SUMMARY OF THE INVENTION

This invention provides a cleaning plug assembly for condenser and heat exchanger tubes, and the like, adapted to be propelled through a tube by fluid pressure injected into the tube, preferably comprising: an elongated body having front and rear end sections; a plurality of spaced resilient scraper elements in the form of annular rings removably and rotatably circumscribing the body at positions spaced inwardly from the front and rear end sections and extending radially outwardly from the body for contacting the inner surface of a tube; each of the rings defining a radially extending cutout therethrough allowing the rings to contract or expand circumferentially when radially or circumferentially directed forces are applied to the ring; stop means such as radially extending projections on the body of a size less than that of the cutouts of the rings for securing each of the rings against free rotation about the body and for allowing the rings to contract; the rings having outer diameters at least generally the same as the inner diameters of a tube to be cleaned whereby the rings will contract and expand within the tubes consistent with the inner dimensions the rings encounter. The body of the plug may be provided with an inner passageway for receiving fluid under pressure to assist movement of the plug through a tube. Radially extending apertures may be provided to communicate with the inner passageway for directing controlled amounts of fluid into the tube as aids in the cleaning process. The elements of the plug assembly may be formed of non-metallic flexible materials capable of bending or flexing and resuming their original shape for allowing the plug to move through restrictions or bends in the tubes. The removable scraper elements permit replacement of worn elements or use of different sized elements for use in different sized tubes. Also, the scraper elements are formed to allow contracting and expanding whereby the elements will conform to the dimensions they encounter within the tube thereby assuring effective cleaner element-to-wall contact.

Various other advantages, details, and modifications of the present invention will become apparent as the following description of certain present preferred embodiments proceed.

DESCRIPTION OF THE DRAWINGS

In the accompanying drawings I show certain present preferred embodiments of my invention in which.

DESCRIPTION OF PREFERRED EMBODIMENTS

Figure 1:
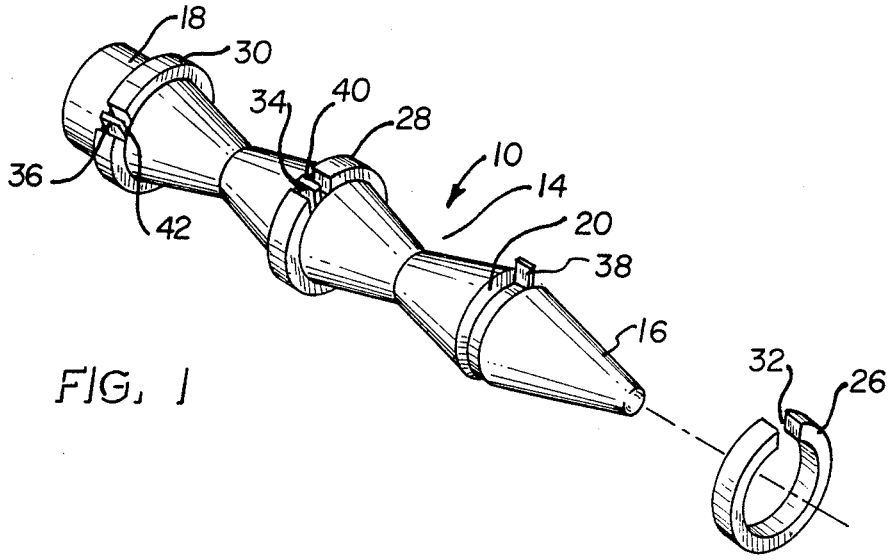
FIG. 1 is a perspective view of a cleaning plug assembly for condenser and heat exchanger tubes and the like, embodying one form of this invention, showing one cleaner ring removed for illustrating the annular grooves in the body which receive the rings.
Figure 2:
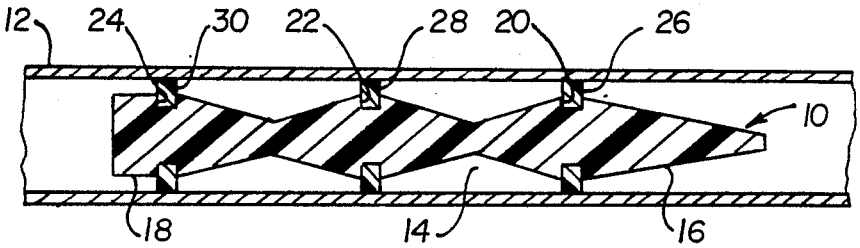
FIG. 2 is a sectional side elevation view of the cleaning plug assembly of FIG. 1 shown located in a tube.

Referring now to the drawings and particularly to FIGS. 1 and 2 there is shown a cleaning plug assembly 10 embodying the present invention for use in cleaning a tube 12 such as condenser or heat exchanger tubes, or the like. The plug assembly 10 is adapted to be propelled through the tube 12 by pressurized fluid injected into the tube. The plug assembly 10 includes an elongated body 14 formed of any suitable material. Body 14 may be rigid in its composition or may be formed from a non-metallic flexible material capable of bending or flexing and resuming its original shape, in which case the plug assembly 10 would be useabled in tubes having restrictions or bends. Body 14 has a conically shaped front end section 16 tapered toward the front end, and a cylindrically shaped rear end section 18. Intermediate the front end section 16 and rear end section 18 are three identically shaped and sized annular grooves 20, 22, and 24, groove 20 being clearly shown in FIG. 1. Scraper elements shown as resilient annular rings 26, 28, and 30, are received in each of the grooves 20, 22, and 24. The rings 26, 28, and 30 as shown are identical in shape and form, each having an outer diameter slightly larger than the inner diameter of the tube 12. The rings 26, 28, and 30 are formed with radial cutouts 32, 34, and 36, which allow the rings to be compressed and expanded as radially or circumferentially directed forces are applied to the rings. Thus when in a tube the rings 26, 28, and 30 will contract or expand to conform to the dimensions they encounter thereby assuring continuous contact of the rings with the tubes throughout passage therethrough. The rings 26, 28, and 30 are removably received in the grooves 20, 22, and 24, and, without any restrictions, would be rotatable within the grooves. Rotation of the rings 26, 28, and 30 is restricted by radially extending projections 38, 40, 42 formed on the body 14 in the grooves 20, 22, and 24. The projections 38, 40, and 42 are sized and shaped smaller than the cutouts 32, 34, and 36 to thereby secure the rings 26, 28, and 30 from free rotation while allowing the rings to compress or contract. The projections 38, 40 and 42 are staggered in their locations within the grooves 20, 22, and 24 to prevent aligning of the cutouts 32, 34, and 36 which, if aligned, would reduce the effectiveness of the pressurized fluid as a propelling agent.

As shown, the body 14 has opposed frusto-conical shapes between the rings 26, 28, and 30, which shapes provide material savings as well as streamlining the body 14 with the conically shaped front section 16, thereby increasing the effectiveness of the plug assembly's 10 movement through a tube 12. Also, the frusto-conical shapes of the body 14 permit effective receipt of cleaning fluids as will be described with respect to another embodiment of the invention.

Figure 3:
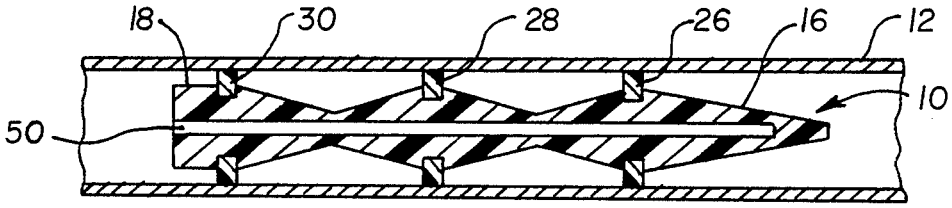
FIG. 3 is a sectional side elevation view of another embodiment of a cleaning plug assembly of this invention showing a central passageway for receiving pressurized fluid to assist movement of the assembly through a tube.
Figure 4:
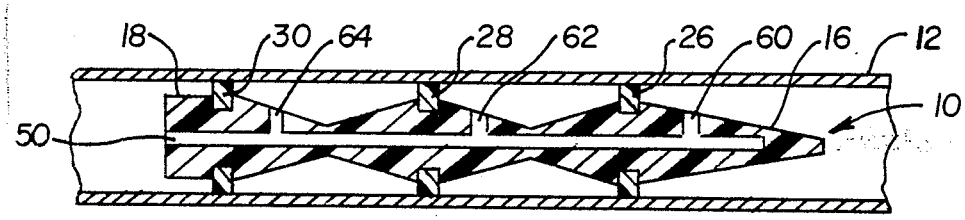
FIG. 4 is a sectional side elevational view of yet another embodiment of a cleaning plug assembly of this invention showing radial apertures communicating with a central passageway for directing controlled amounts of fluid externally of the plug for aiding in the tube cleaning process.

FIGS. 3 and 4 illustrate other embodiments of this invention. The essential features of the embodiment of these figures are the same as the embodiment described previously in regard to FIGS. 1 and 2, and the elements of FIGS. 3 and 4 will be given the same identifying numerals as represented in FIGS. 1 and 2. The body 14 of the plug assembly 10 of FIG. 3 is provided with an elongated central passageway 50 open at its rear end and extending forward to a point within the front section 16. The passageway 50 will receive pressurized propelling fluid and thereby assist movement of the plug assembly 10 through the tube 12.

The body 14 of the plug assembly 10 of FIG. 4 is provided with an elongated pressurized fluid receiving central passageway 50, and is also provided with radially extending apertures 60, 62, and 64 communicating between the passageway 50 and externally of the body. Controlled amounts of fluid, such as solvents, may be directed through the apertures 60, 62, and 64 to aid in the tube cleaning process. The frusto-conical body sections between the rings 26, 28, and 30 will allow for receipt and temporary storage of the fluids in anticipation of the fluids serving to dissolve or otherwise assist in cleaning foreign matter from the tubes.

It should now be clearly apparent how the cleaning plug assembly of this invention provides the new results and advantages described earlier in the introductory portion of this specification. The cleaning elements conform to the surface they encounter within tubes and may be simply replaced or changed when they wear, or to accommodate different sizes of tubes. There should also be obvious other modifications of this invention. One such modification should be adapting the front end section 16 to receive another cleaning element such as a wire brush, or the like.

While I have shown and described certain preferred embodiments of this invention, and suggested certain modifications, it is to be distinctly understood that the invention is not limited thereto, but may be otherwise embodied within the scope of the following claims.

I claim:

1. A cleaning plug assembly for condenser and heat exchanger tubes and the like, adapted to be propelled through a tube by fluid pressure injected into the tube, comprising:

an elongated body having front and rear end sections;

a plurality of spaced resilient annular rings removably and rotatably circumscribing said body at positions spaced inwardly from said front and rear end sections and extending radially outwardly from said body for contacting the inner surface of a tube;

each of said rings defining a radially extending cutout therethrough allowing the rings to contract or expand circumferentially when radially or circumferentially directed forces are applied to the ring;

stop means on said body of a size less than that of said cutouts of said rings for securing each of said rings against free rotation about said body and for allowing the rings to contract; and said rings having outer diameters at least generally the same as the inner diameter of a tube to be cleaned whereby the rings will contract and expand within the tubes consistent with the inner dimensions the rings encounter.

2. A cleaning plug assembly as set forth in claim 1 wherein the outside diameters of said rings are slightly greater than the inside diameter of a tube to be cleaned.

3. A cleaning plug assembly as set forth in claim 1 wherein said body is formed of a non-metallic flexible material capable of bending or flexing and resuming its original shape.

4. A cleaning plug assembly as set forth in claim 1 wherein said body defines an elongated central passageway open at its rear end and extending forward to a point at least intermediate the front and rear ends of the body for receiving fluid pressure to assist movement of the plug assembly through a tube.

5. A cleaning plug assembly as set forth in claim 1 wherein said front section of said body being of a generally conical shape tapering to an apex at the forwardmost point of the body.

6. A cleaning plug assembly as set forth in claim 4 wherein said body defines at least one radially extending aperture therethrough communicating with said passageway for directing a controlled amount of fluid externally of the body.

7. A cleaning plug assembly as set forth in claim 1 wherein said stop means are axially staggered on said body whereby said cutouts of said rings will be axially unaligned.

8. A cleaning plug assembly as set forth in claim 1 wherein said body defines spaced circumferential grooves; said rings are received in said grooves; said front section of said body is formed in a generally conical forward tapering shape; said body defines an elongated passageway open at its rear end and extending forward to a point in said front section of said body; said body defines radially extending apertures through said front section and in-between said rings communicating with said passageway for directing controlled amounts of fluid externally of the body; and said body having sections between said rings sized and shaped for receiving the controlled amounts of fluid during tube cleaning.

* * * * *